US006544302B2

(12) United States Patent
Berger et al.

(10) Patent No.: US 6,544,302 B2
(45) Date of Patent: Apr. 8, 2003

(54) COMPOSITE CANDLE COMPOSITIONS

(75) Inventors: Vivian Berger, Dumont, NJ (US); Virgil A. G. Williams, Brooklyn, NY (US); Randall Richards, Manor, TX (US)

(73) Assignee: Bush Boake Allen, Montvale, NJ (US)

( * ) Notice: Subject to any disclaimer, the term of this patent is extended or adjusted under 35 U.S.C. 154(b) by 0 days.

(21) Appl. No.: 09/465,991

(22) Filed: Dec. 16, 1999

(65) Prior Publication Data

US 2003/0024152 A1 Feb. 6, 2003

Related U.S. Application Data

(60) Provisional application No. 60/137,056, filed on Jun. 1, 1999.

(51) Int. Cl.[7] ..... C11C 5/00

(52) U.S. Cl. ..... 44/275; 431/288; 431/289; 431/291

(58) Field of Search ..... 44/275; 431/288, 431/289, 291

(56) References Cited

U.S. PATENT DOCUMENTS

| | | | | | |
|---|---|---|---|---|---|
| 2,279,137 | A | | 4/1942 | Guilfoil, Jr. | 67/21 |
| 3,615,289 | A | | 10/1971 | Felton | 44/7.5 |
| 3,645,705 | A | | 2/1972 | Miller et al. | 44/7.5 |
| 3,741,711 | A | | 6/1973 | Bryant | 431/125 |
| 3,819,342 | A | | 6/1974 | Gunderman et al. | 44/7.5 |
| 4,051,159 | A | | 9/1977 | Tsoucalas et al. | 260/404.5 |
| 4,115,370 | A | | 9/1978 | Corrado | 260/22 CQ |
| 4,150,002 | A | | 4/1979 | Drawert et al. | 260/18 N |
| 4,332,548 | A | * | 6/1982 | Linton | 44/275 |
| 4,341,671 | A | | 7/1982 | Bolze et al. | 528/324 |
| 4,346,024 | A | | 8/1982 | Coquard et al. | 524/219 |
| 4,369,284 | A | | 1/1983 | Chen | 524/476 |
| 4,427,366 | A | | 1/1984 | Moore | 431/291 |
| 4,449,987 | A | | 5/1984 | Lindauer | 44/7.5 |
| 4,507,077 | A | * | 3/1985 | Sapper | 44/275 |
| 4,552,693 | A | | 11/1985 | Hussain et al. | 252/522 |
| 4,568,270 | A | | 2/1986 | Marcus et al. | 431/288 |
| 4,663,428 | A | | 5/1987 | Okitu et al. | 528/324 |
| 4,826,428 | A | | 5/1989 | Lam | 431/291 |
| 4,855,098 | A | | 8/1989 | Taylor | 264/103 |
| 4,937,701 | A | | 6/1990 | Schroder | 362/161 |
| 5,132,355 | A | | 7/1992 | Nahlovsky | 524/474 |
| 5,221,534 | A | | 6/1993 | DesLauriers et al. | 424/78.03 |
| 5,338,187 | A | | 8/1994 | Elharar | 431/288 |
| 5,395,233 | A | | 3/1995 | Karp | 431/289 |
| 5,578,089 | A | | 11/1996 | Elsamaloty | 44/275 |
| 5,597,300 | A | | 1/1997 | Wohl et al. | 431/288 |
| 5,603,925 | A | | 2/1997 | Ross et al. | 424/65 |
| 5,632,615 | A | | 5/1997 | DeGarmo | 431/288 |
| 5,693,277 | A | | 12/1997 | Widmer | 264/153 |
| 5,705,175 | A | | 1/1998 | Johnson | 424/409 |
| 5,773,706 | A | | 6/1998 | Wesley et al. | 44/266 |
| 5,783,657 | A | | 7/1998 | Pavlin et al. | 528/310 |
| 5,833,971 | A | | 11/1998 | Baldwin | 424/76.4 |
| 5,842,850 | A | | 12/1998 | Pappas | 431/291 |
| 5,843,194 | A | | 12/1998 | Spaulding | 44/275 |
| 5,871,553 | A | | 2/1999 | Spaulding | 44/275 |
| D407,164 | S | | 3/1999 | Bell et al. | D26/6 |
| 5,879,694 | A | | 3/1999 | Morrison et al. | 424/405 |
| 5,882,363 | A | | 3/1999 | Spaulding et al. | 44/275 |
| D411,891 | S | | 7/1999 | Bell et al. | D26/6 |
| 6,033,210 | A | | 3/2000 | Freeman | 431/291 |
| 6,068,472 | A | * | 5/2000 | Freeman et al. | 431/291 |
| 6,096,102 | A | * | 8/2000 | Matthai | 44/275 |
| 6,129,771 | A | * | 10/2000 | Ficke et al. | 44/275 |
| 6,214,063 | B1 | | 4/2001 | DeStefano et al. | 44/275 |
| 6,214,295 | B1 | * | 4/2001 | Freeman | 422/126 |

FOREIGN PATENT DOCUMENTS

| | | |
|---|---|---|
| WO | WO 88/00603 | 1/1988 |
| WO | WO 97/08282 | 3/1997 |
| WO | WO 97/27424 | 7/1997 |
| WO | WO 98/17243 | 4/1998 |
| WO | WO 98/48325 | 10/1998 |
| WO | WO 99/08722 | 2/1999 |
| WO | WO 99/09120 | 2/1999 |
| WO | WO 00/46326 | 8/2000 |

* cited by examiner

*Primary Examiner*—Cephia D. Toomer

(57) ABSTRACT

Candles are disclosed that include a wick, a first phase and a second phase. In one embodiment, the first phase is substantially clear and has a first melting point, the second phase is visually distinct from the first phase and has a second melting point, and the second melting point is greater than or about equal to the first melting point. In another embodiment, the first phase contains a first concentration of gellant in first solvent, the second phase contains a second concentration of gellant in second solvent, and the first and second concentrations are non-identical. In another embodiment, the first and second phases each contain gellant, however the second phase contains components not present in the first phase.

81 Claims, No Drawings

COMPOSITE CANDLE COMPOSITIONS

CROSS-REFERENCE TO RELATED APPLICATION

This application claims the benefit of priority from abandoned U.S. provisional patent application No. 60/137,056, filed Jun. 1, 1999, the entire disclosure of which is hereby incorporated herein by reference.

TECHNICAL FIELD OF THE INVENTION

The invention relates to candles, and in particular to candles that include at least two solid phases.

BACKGROUND OF THE INVENTION

For much of their history, candles have been primarily a utilitarian item, in that they provided light to otherwise darkened spaces. With the advent of electrical lighting, most homeowners relegated candles to the back of a drawer, using them only during the occasional power failure, or to add some festivity to birthday parties and holiday tables. However, the past decade or so has seen resurgence in the popularity of candles.

The National Candle Association (Washington, D.C.; www.candles.org) reports that U.S. candle consumer retail sales for 1999 are projected at $2.3 billion, not including candle accessories such as snuffers, lighters and candleholders. Since the early 1990's, the industry has averaged a growth rate of 10–15% annually. In recent years, this growth has doubled. The U.S. market is typically separated into seasonal (Christmas Holiday) business at roughly 35%, and non-seasonal business at about 65%, where candles are used in 7 out of 10 U.S. households.

This resurgence is due, in part, to the public's perception that a lighted candle provides an aesthetically pleasing light, and a sense of well being within a space where the candle is burning. Furthermore, the public has recently become interested in aromatherapy, and many of the scents espoused by aromatherapists may be placed into, and dispensed from, a burning or non-burning candle.

However, another factor that contributes to the recent popularity of candles is that they are becoming more attractive. Candles need no longer be in the form of a block or taper of white paraffin wax. Increasingly, the public is being exposed to, and coming to demand, more interesting shapes and designs for candles. Accordingly, there is a need in the art for compositions that can be used to form these interesting shapes and designs, and that can allow for the manufacture of heretofore-unseen shapes and designs for candles. The present invention provides these and other related advantages as disclosed below.

SUMMARY OF THE INVENTION

Briefly stated, the present invention provides a composite candle. In other words, a candle that contains at least two macroscopically distinct phases. The candles of the present invention include a wick, a first phase and a second phase. The first phase includes a first gelled fuel, where the first gelled fuel includes a first gellant at a first concentration in a first solvent, and the first gelled fuel has a first melting point.

In one aspect, the second phase includes a second gelled fuel, where the second gelled fuel includes a second gellant at a second concentration in a second solvent, and the second gelled fuel has a second melting point; such that the first and second phases are non-identical.

In another aspect, the second phase includes wax and has a second melting point, wherein a) the second melting point is greater than or about equal to the first melting point, and/or b) the second phase is adjacent to, and not encased by, the first phase.

In another aspect, the second phase includes a) decorative items positioned on the surface of the first phase; and/or b) one or more non-flammable items positioned within the first phase.

In another aspect, the present invention provides a solid candle that includes a wick, a first phase and a second phase. The first phase has a first melting point, and includes a fuel and is, substantially clear. The second phase has a second melting point, includes a fuel, and is visually distinct from the first phase. The second melting point is greater than or about equal to the first melting point. The first and/or second phase may contain a first and/or second gellant. The first and/or second phase may contain wax.

In optional embodiments of the invention, the first and/or second gellant is selected from polyamide, polyesteramide, and block copolymer; where a preferred polyesteramide is an ester-terminated polyamide of the formula (1):

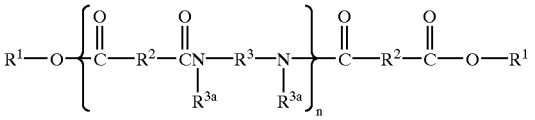

(1)

wherein, n designates a number of repeating units such that ester groups constitute from 10% to 50% of the total of the ester and amide groups;

$R^1$ at each occurrence is independently selected from hydrocarbyl groups;

$R^2$ at each occurrence is independently selected from a $C_{2-42}$ hydrocarbon group with the proviso that at least 10% of the $R^2$ groups have 30–42 carbon atoms;

$R^3$ at each occurrence is independently selected from an organic group containing at least two carbon atoms in addition to hydrogen atoms, and optionally containing one or more oxygen and nitrogen atoms; and $R^{3a}$ at each occurrence is independently selected from hydrogen, $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$.

In other optional embodiments, the first and/or second solvent is selected from mineral oil, fatty acid ester, fatty acid glycol and fatty alcohol; the first and second concentrations are identical; the first and second concentrations are non-identical; the first and second melting points are identical; the first and second melting points are non-identical; the first and second gellants are identical; the first and second gellants are non-identical.

In other optional embodiments, the first and/or second gelled fuel is substantially clear; the first or second phase contains one or more components not present in the other phase, the components rendering the first and second phases visually distinct; and/or the first phase contacts and substantially encases the second phase. In a preferred embodiment, the first phase contains gellant and is substantially clear.

In other optional embodiments, the candle is positioned within a container or is freestanding. When free-standing, the candle may have a coating that forms the exterior-most surface of the candle, where the coating may be formed, in part or whole of polyamide resin. A candle of the invention may contain fragrance and/or clarifying agent and/or opacifying agent, where the clarifying agent may be selected from $C_{10}$–$C_{22}$monocarboxylic acid and alkylene glycol, and the opacifying agent may be selected from paraffin, titanium dioxide, dye, zinc oxide, wax, solid fatty acid, solid fatty alcohol, and opacifying resin.

At least one of the first phase and the second phase may contain a decorative item. Non-flammable components, such as components made from glass and/or metal, may be present in a candle of the present invention.

In optional embodiments, the first melting point is between 90° F. and 200° F.; and/or the second melting point is greater than the first melting point; and/or the second melting point is within 5° F. of the first melting point. In other optional embodiments, the first concentration is within the range of about 2–65 wt % and the second concentration is within the range of about 10–75 wt %, the wt % values based on the total weight of gellant and solvent.

In another aspect, the present invention provides a composition that includes gellant, solvent for the gellant, and wax, the composition being homogeneous on a macroscopic scale. The composition may be placed within substantially clear first phases, where it will be visually distinct from the first phases.

The present invention also provides a process for preparing candles as described above, the process including combining a first phase, a second phase, and a wick.

These and related aspects of the invention are described further below.

DETAILED DESCRIPTION OF THE INVENTION

The present invention provides a candle that includes a wick, a first phase and a second phase. The first phase includes a first gelled fuel, where the first gelled fuel includes a first gellant at a first concentration in a first solvent, and the first gelled fuel has a first melting point. As used herein, a gelled fuel is a combination of gellant and solvent that has a gel consistency, and can function as a fuel in a burning candle.

In one aspect, the candle has a second phase that includes a second gelled fuel, where the second gelled fuel includes a second gellant at a second concentration in a second solvent, and the second gelled fuel has a second melting point; such that the first and second phases are non-identical.

In another aspect, the candle has a second phase that includes wax, and the second phase has a second melting point, wherein a) the second melting point is greater than or about equal to the first melting point, and/or b) the second phase is adjacent to, and not encased by, the first phase.

In another aspect, the candle has a second phase that includes a) decorative items positioned on the surface of the first phase; and/or b) one or more non-flammable items positioned within the first phase.

While a candle of the invention includes at least two phases, the candle may have more than two phases. In one embodiment, the candle has three phases. However, when the candle has only two phases, those two phases are each solid. The term solid has its ordinary meaning, in that it denotes a physical state excluding liquids and gases, where solids resist deformation by impacting pressure. Furthermore, as used herein, the term solid includes gels, where gels are the result of combining a liquid solvent and a gellant. The term gel also includes supercooled liquids, where supercooled liquids may also be the result of combining a liquid solvent and a gellant. A gel resists deformation, but does deform to some extent upon application of pressure, and then returns to its original shape when the pressure is removed. When the candle includes more than two phases, at least two of the phases are solid, and in one embodiment, all of the phases are solid. The two phases that are necessarily present in a candle of the present invention are referred to herein as the first phase and the second phase.

The first and second phases are both present in a single candle. The first and second phases contact one another, but occupy separate space within the candle. Accordingly, a candle of the present invention is not a homogeneous structure. A phase is more than a molecular layer thick, and typically occupies a volume of about several cubic millimeters. Thus, the first and second phases are not distinct merely on a microscopic level, but are macroscopically distinct. Typically, the first and second phases will be physically separated from each other prior to a time when they are combined (or otherwise contacted with one another) so as to form the composite candle. In one aspect, the invention provides forming a first phase, forming a second phase, and then contacting the first and second phases.

The first and second phases are distinct from one another in at least one way. For example, in one embodiment, the two phases have different melting points, and at least one of the two phases preferably is substantially clear. In another embodiment, the two phases each contain gellant and solvent, however the concentrations of gellant in solvent are different between the two phases. In another embodiment, the two phases each contain gellant, however one phase contains components not present in the other phase. In other embodiments, the two phases differ from each other in two or more of the ways set forth above.

In one embodiment, the phases are similar in that each contains, at least in part, fuel. The fuel may be, but need not be, the same in the two phases. For example, the fuels may both be gelled fuel. Alternatively, the fuels may be different, e.g., gelled fuel in one phase and wax in the other phase. The fuel(s), along with the wick(s), provide, at least in part, the material that is burned when the candle is lit.

The first and/or second phase may be, or include, a gel. Typically, the gel is formed from a polymeric organic gellant and a solvent. The gellant is a material that gels a solvent, and the solvent is a liquid that interacts with the gellant to form a gel. Suitable gellants are known in the art, and representative examples include polyamide gellants, polyesteramide gellants (e.g., ester-terminated polyamide), and block copolymer gellants (e.g., thermoplastic elastomers). Suitable gels, made from these or other gellants, are also known in the art, and some of these gels are described below.

For instance, a gel may be prepared by combining a polyamide gellant with an oil solvent as described in U.S. Pat. No. 3,645,705 to Miller et al. As set forth in Miller, the polyamide may be a long-chain linear amide resin derived from the reaction of dimerized linoleic acid with di- or poly-amines; typically with a molecular weight (number or weight average) in the range of 6,000 to 9,000 and a softening point in the range of 48° C. to 185° C. The polyamide is capable of producing a gel structure in oil when the solubility of the polyamide in the oil is exceeded.

Alternatively, the gel may be formed according to U.S. Pat. No. 3,819,342 to Gunderman et al. Thus, a thermoplastic polyamide resin gellant and a solvent may be combined to form a gel, where the polyamide resin is preferably formed by the reaction of an aliphatic polycarboxylic acid with a di- or poly-amine. These resins have an average molecular weight of between 2,000 and 10,000 and are described in great detail in U.S. Pat. Nos. 2,379,413 and 2,450,940.

As another alternative, the gel may be prepared according to U.S. Pat. No. 3,615,289 to Robert Felton. Thus, a gel may be formed by combining a solid polyamide resin gellant, an alkanol amine or alkanol amide, and one or more stearic acid esters or a mixture of stearic acid esters and stearic acid. The solid polyamide resin gellant of Felton is the soluble condensation product of an aliphatic dicarboxylic acid and a diamine, the carboxyl and amino groups of adjacent monomer units being condensed to an amide linkage in the resin. The resin may also be based on carboxylic and amine compounds having more than two carboxyl and amino groups respectively. The resin is composed primarily of polyamides of molecular weight within the range of from about 2,000 to about 10,000, and are of the type generally set forth in U.S. Pat. No. 2,450,940.

As a further alternative, the gel may be prepared by the procedures and reactants set forth in U.S. Pat. No. 5,578,089 to Mohamed Elsamaloty. According to Elsamaloty, a gel may be prepared from hydrocarbon oil and thermoplastic elastomer(s) gellant, such as diblock and triblock copolymers based on synthetic thermal plastic rubbers. The rubber blend is prepared from at least one diblock and at least one triblock copolymer, in addition to one or both of radial copolymers and multiblock copolymers. KRATON™ rubbers from Shell Chemical Company, which include styrene-butadiene-styrene copolymers and styrene-isoprene-styrene copolymers, are preferred. In a related embodiment, the gel comprises from about 70% to about 98% by weight of a hydrocarbon oil, from about 2% to about 30% by weight a copolymer selected from the group consisting of a triblock, radial block and multiblock copolymer, and from 0 to about 10% by weight of a diblock copolymer, as described in, e.g., PCT International Publication No. WO 97/08282. Chemically-related gels, which are also suitable for use in the present invention, are set forth in U.S. Pat. Nos. 5,705,175 and 5,879,694.

Clear and/or substantially clear gel formulations containing hydrogenated polyolefin, e.g., polyisobutene, may be used in the present invention. Suitable formulations are set forth in U.S. Pat. No. 5,843,194 to L. Spaulding, and may include a gelling agent as also disclosed in the '194 patent. A suitable polyolefin is PANALANE™ from Lipo Chemical (Paterson, N.J.) or IDOPOL™ from Amoco Chemical Comp. (Chicago, Ill.). The gelling agent may be a derivative of an N-acyl amino acid, such as set forth in U.S. Pat. No. 5,429,816, including N-acyl amino acid amides and N-acyl amino acid esters prepared from glutamic acid, lysine, glutamine, aspartic acid and mixtures thereof. N-acyl glutamic acid diamine, commercially available as AJINOMOTO™ GP-1, from Ajinomoto Co. (Tokyo, Japan) is a suitable gelling agent.

A particularly preferred gelling agent of the present invention is ester-terminated polyamide (ETPA), which is an exemplary polyesteramide. A polyesteramide contains both amide and ester groups, and repeating moieties. Suitable ester-terminated polyamides are disclosed in U.S. Pat. No. 5,783,657 to Pavuin et al. A suitable ester-terminated polyamide gellant has the formula (1):

(1)

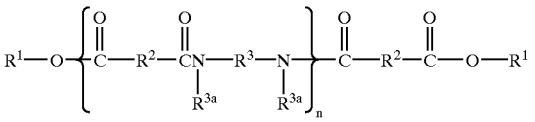

wherein, n designates a number of repeating units such that ester groups constitute from 10% to 50% of the total of the ester and amide groups;

$R^1$ at each occurrence is independently selected from hydrocarbyl groups;

$R^2$ at each occurrence is independently selected from a $C_{2-42}$ hydrocarbon group with the proviso that at least 10% of the $R^2$ groups have 30–42 carbon atoms;

$R^3$ at each occurrence is independently selected from an organic group containing at least two carbon atoms in addition to hydrogen atoms, and optionally containing one or more oxygen and nitrogen atoms; and $R^{3a}$ at each occurrence is independently selected from hydrogen, $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$.

Ester-terminated polyamides, and gels made therefrom, may be obtained according to the procedures set forth in the '657 patent. In addition, a suitable ester-terminated polyamide is commercially available from International Paper Company (Purchase, N.Y.) under their UNICLEAR™ trademark. Other suitable gels are set forth in PCT International Publication No. WO 98/17243, and include gels made from ETPA (described above) and ester-terminated dimer acid-based polyamides (ETDABP) as described in WO 98/17243, where these abbreviations are used and defined in WO 98/17243.

In addition to the gellant, a gelled fuel contains a solvent that, upon combination with the gellant, forms a gel. Suitable solvents for a particular gellant are set forth in the above-listed patents and publications describing gellants. Preferred solvents to prepare phases present in candles of the present invention include mineral oil, fatty acid ester, fatty acid glycol and fatty alcohol.

The solvent present in the gel is preferably flammable, and thus serves, in part, as fuel for a candle of the present invention. A flammable solvent for preparing suitable gels for candles of the invention typically has a flash point ranging from about 40° C. to about 300° C., preferably ranging from about 130° C. to about 225° C., and more preferably ranging from about 150° C. to about 200° C. Candles are typically intended for slow burning and may be left unobserved for periods of time. For these reasons, a relatively higher flash point is generally preferred for a candle, so that the candle burns more slowly and safely.

Particularly when ETPA is the gellant, a preferred solvent is a low polarity liquid, where a preferred low polarity liquid is a hydrocarbon, and preferred hydrocarbons are oils. As used herein, the term solvent includes any substance which is a liquid at a temperature between 10–60° C., and which forms a gel upon being combined with a gellant. The prior art sometimes distinguishes between solvents and oils, in that defatting occurs when solvents are rubbed on human skin, leading to drying and irritation, however, defatting does not occur when oils are rubbed on human skin. As used herein, the term solvent will be used to encompass oils and other fluids that may be gelled, and is not limited to liquids that cause defatting of human skin.

Many different oils may be used as solvents in the present invention, including synthetic oil, vegetable oil, animal oil and mineral oil. However a preferred oil is mineral oil, sometimes referred to as medicinal oil. A preferred mineral oil to prepare a gel is so-called "white" mineral oil, which is water-white (i.e., colorless and transparent) and is generally recognized as safe for contact with human skin. Mineral oils are available commercially in both USP and NF grades. USP mineral oils have viscosities that range from 35 cSt to 100 cSt, and pour points that range from −40° C. to −12° C. NF light mineral oils have lower viscosities, typically 3–30 cSt, and pour points as low as −45° C. The mineral oil may be of technical grade, having a viscosity ranging from 4–90 cSt and a pour point ranging from −12° C. to 2° C. Examples of suitable, commercially available mineral oils include SONNEBORN™ and CARNATION™ white oils from Witco Corporation (Greenwich, Conn.; http://www.witco.com), ISOPARR™ K and ISOPAR™ H from Exxon Chemical Company (Houston, Tex.; http://www.exxon.com/exxonchemical), and DRAKEOL™ and PENETECK™ white mineral oils from Penreco (Karns City, Pa.).

Other hydrocarbon solvents that may be used in the invention include relatively lower molecular weight hydrocarbons including linear saturated hydrocarbons such a tetradecane, hexadecane, octadecane, etc. Cyclic hydrocarbons such as decahydronaphthalene (DECALIN™), fuel grade hydrocarbons, branched chain hydrocarbons such as PERMETHYL™ hydrocarbons from Permethyl Corporation and ISOPAR™ hydrocarbons from Exxon Chemical, and hydrocarbon mixtures such as product PD-23 hydrocarbons from Witco Corp. (Greenwich, Conn.) may also be used in preparing gels of the invention. Such hydrocarbons, particularly saturated hydrocarbon oils, are a preferred solvent for preparing a gel phase in a candle of the present invention.

Another class of suitable low polarity liquid solvents is esters, and particularly esters of fatty acids. Such esters may be monofunctional esters (i.e., have a single ester moiety) or may be polyfunctional (i.e., have more than one ester group). Suitable esters include, but are not limited to, the reaction products of $C_{1-24}$ monoalcohols with $C_{1-22}$ monocarboxylic acids, where the carbon atoms may be arranged in a linear, branched and/or cyclic fashion, and unsaturation may optionally be present between carbon atoms. Preferably, the ester has at least about 18 carbon atoms. Examples include, but are not limited to, fatty acid esters such as isopropyl isostearate, n-propyl myristate, isopropyl myristate, n-propyl palmitate, isopropyl palmitate, hexacosanyl palmitate, octacosanyl palmitate, triacontanyl palmitate, dotriacontanyl palrnitate, tetratriacontanyl palmitate, hexacosanyl stearate, octacosanyl stearate, triacontanyl stearate, dotriacontanyl stearate and tetratriacontanyl stearate; salicylates, e.g., $C_{1-10}$ salicylates such as octyl salicylate, and benzoate esters including $C_{12-15}$ alkyl benzoate, isostearyl benzoate and benzyl benzoate. Suitable esters include glycerol and propylene glycol esters of fatty acids, including the so-called polyglycerol fatty acid esters and triglycerides. Exemplary esters include, without limitation, propylene glycol monolaurate, polyethylene glycol (400) monolaurate, castor oil, triglyceryl diisostearate and lauryl lactate. Thus, the solvent may have more than one of ester, hydroxyl and ether functionality. For example, $C_{10-15}$ alkyl lactate may be used in forming a gel of the invention. In addition, esterified polyols such as the polymers and/or copolymers of ethylene oxide, propylene oxide and butylene oxide reacted with $C_{8-22}$ monocarboxylic acids are useful. The carbon atoms of the $C_{8-22}$ monocarboxylic acids may be arranged in a linear, branched and/or cyclic fashion, and unsaturation may be present between the carbon atoms. Preferred esters are the reaction product of an alcohol and a fatty acid, where the alcohol is selected from $C_{1-10}$ monohydric alcohol, $C_{2-10}$ dihydric alcohol and $C_{3-10}$ trihydric alcohol, and the fatty acid is selected from a $C_{8-24}$ fatty acid. Two triglyceride esters that are commercially available and may be used as a solvent in the present invention are SOFTIGEN™ ester from Hüls America of Piscataway, N.J. (a $C_{10}$–$C_{18}$ triglyceride), and NEOBEE™ M5 ester from Stepan Company (Northfield, Ill.; http://www.stepan.com) (a liquid capric/caprylic triglyceride).

Preferably, the solvent is or contains a low-polarity liquid as described above, and more preferably the solvent is or contains a liquid hydrocarbon. The liquid may contain more than one component, e.g., it may contain hydrocarbon as well as ester-containing material. In the mixture, the gellant (e.g., ETPA or ETDABP) contributes about 10–95%, and the solvent contributes about 5–90% of the combined weight of the gellant and the solvent. Preferably, the gellant is combined with the solvent such that the weight percent of gellant in the gellant+solvent mixture is about 5–50%, and preferably is about 10–45%. Such gels may be transparent, translucent or opaque, depending on the precise identities of the gellant and solvent, as well as the concentration of gellant in the mixture. In a preferred embodiment, the gel is transparent or translucent, and more preferably is transparent.

In order to prepare a gel from gellant and solvent, the two components are mixed together and heated until homogeneous. A temperature within the range of about 80–150° C. is typically sufficient to allow the gellant to completely dissolve in the solvent. A lower temperature may be used if a solution can be prepared at the lower temperature. Upon cooling, the mixture forms a gel that may be present as a phase in a candle of the present invention.

In some instances, a gel may adhere to the sides of the container in which the gel is formed. During cooling, the molten homogeneous mixture will undergo some contraction, which may be impeded if the gel sticks to the sidewalls of the container. In these instances, cracks may form in the cooling gel, because the contracting gel is adhering to the container. When a crack-free candle or phase is desired, such a product may be prepared by allowing the gel to cool to just above its gel point, and then pouring the cooled gel into a mold. In this way, the degree of cooling, and hence contraction, that occurs within the mold is minimized, with concomitant reduction in cracking.

If desired, the molten mixture may be poured into a mold or jar, and the mixture cooled therein to form a phase for a candle. The mold may be used when the gel phase desirably has an ornamental exterior surface. For example, the mold may impart various designs, in a relief fashion, to the surface of the gel phase. Molds to achieve various relief surfaces are commonly used in the preparation of paraffin-based candles, and may be used to prepare composite candles of the present invention. An appropriate quantity of mold-release agent may be placed on the interior mold surface, in order to facilitate removal of the gel from the mold. Suitable mold-release agents that contain silicon or fluorocarbon are known in the art and are available from many commercial sources.

Alternatively, the molten mixture may be poured into a jar or like container, to permanently hold the gel. The jar may be formed of clear or colored glass, and have essentially any shape, according to the aesthetic preferences of the manufacturer. Alternatively, the jar may be formed of any other non-flammable substance, e.g., metal. A noteworthy feature of certain gel phases of the candle compositions of the present invention is their substantially clear and colorless appearance, and thus containers that allow the consumer to appreciate this appearance, e.g., clear glass or mirrored surface jars, are preferred.

The first and/or second phase may include a wax, even in instances where the phase also includes gelled fuel. Essentially any wax may be used. For instance, the wax may be a fully refined paraffin wax, or a partially refined (e.g., scale or slack) paraffin wax. The wax may be petroleum wax, including one or more of a paraffin, ceresine, ozokerite and microcrystalline wax. The wax may be a natural wax, such as candelilla wax, beeswax, or camauba wax. The wax may be a synthetic wax, such as a product of the Fischer-Tropsch process, or a polyethylene wax. In a preferred embodiment, the first phase is a transparent gel and the second phase is a wax, where the wax has a melting point that is greater than or about equal to the melting point of the gel.

Waxes spanning a range of melt points are commercially available. For example Moore & Munger, Inc. (Shelton, Conn.; www.mooremunger.com) sells paraffin waxes with melt points (as measured by ASTM D87, ° F.) of 126, 131, 136, 141, 142, 151, 156, 157 and 159. The wax may be a microcrystalline wax, where Moore & Munger, Inc. sells microcrystalline waxes with melt points (ASMT D87, ° F.) of 130, 156, 161, 165, 170, 175, 176, 178, 179, 181, 186, 188, 195 and 196. The wax may be a synthetic wax produced by the Fischer-Tropsch process. Moore & Munger, Inc. sells synthetic waxes having softening points (Ring & Ball, ° F.) ranging from 203–212. Other vendors of suitable waxes include, for example, Hase Petroleum Wax Company (Arlington Heights, Ill.; www.hpwax.com), and the International Group, Inc. (Wayne, Pa.; www.igwax.com).

Because both the first and second phases include material(s) that function as fuel for the candle, neither the first nor second phase should contain material that would effectively extinguish a burning candle. Accordingly, neither the first or second phases preferably contains any appreciable amount of water. Non-aqueous first and second phases are thus preferred for the candles of the present invention. The gellants useful in the present invention are thus those gellants that may gel organic materials, rather than gellants than form gels exclusively upon exposure to moisture.

The candles of the present invention also contain a wick. When the candle contains a single wick, which is a preferred embodiment of the invention, the wick is preferably positioned in the center of the candle. Alternatively, the candle may have a plurality of wicks. Upon burning, the candle preferably displays a bright, calm flame, and gradually forms a pool surrounding the so-called cup rim.

Commercially available candlewicks may be present in the candles of the present invention. A preferred wick is made from uniform, tear-resistant cotton yam made of medium- and/or long-stapled cotton that is seasoned and does not have moisture damage. The precise wick is preferably selected, in part, based on the size of the candle. A typical wick has from 15–42 strands (plys). A larger wick (more strands) is preferred for a larger candle. A transparent wick may be used, so that the entire candle (wick plus fuel, and coating if present) may be transparent. The wick should be free of contaminants that impair a capillary effect needed for desirable burning. The wick should not leave ashes upon burning, and it preferably burns without significantly visible release of soot.

The wick may be embedded with wax or other additive(s) that facilitates or provides desired burning properties. For example, the wick may be colored using a water or alcohol soluble dye. Suitable dyes include, without limitation, F,D&C Blue #1, D&C Orange #4, Ext D&C Violet #2, F,D&C Red #4, D&C Red #33, F,D&C Red #40, D&C Green #8, D&C Yellow #10, F,D&C Yellow #5 and D&C Green #5. Alternatively, or additionally, the wick may contain fragrance and/or air freshener components. PCT International Publication No. WO 99/09120 discloses such wicks. The wick may be joined to a container, where the first and second phases are also positioned within the container. A suitable container of this nature is disclosed in PCT International Publication No. WO 97/27424.

In one embodiment of the present invention, the first phase is substantially clear. There are various degrees of clarity, ranging from crystal clear to hazy, which may be achieved with gels, and are encompassed by the substantially clear phase(s) of the present candles. In order to provide some measure of the absolute clarity of a phase, the following test may be used. A white light is shined through a phase of a given thickness at room temperature, and the diffuse transmittance and the total transmittance of the light are determined. The percent haze for a sample is determined by the equation: %haze=(diffuse transmittance/total transmittance)×100. Samples are prepared by melting the phase (e.g., gel) and pouring the melt into 50-mm diameter molds. The samples may be prepared at 'two thickness', e.g., 5.5±0.4 mm and 2.3±0.2 mm.

Clarity measurements may be made on a Hunter Lab Ultrascan Sphere Spectrocolorimeter using the following settings: specular included, UV off, large area of view, illuminate D65, and observer 10°. Using this protocol with a 2.3 mm thickness sample, a clear phase has a %haze value of less than about 20, preferably less than about 10, more preferably less than about 5, while paraffin wax has a %haze value of over 90. The %haze value for a gel phase can be increased if desired, by appropriate selection of solvent and gellant.

In a preferred embodiment, the two phases of a composite candle of the present invention have melting points such that the second phase is not substantially melted upon contact with a first phase, when the first phase is molten and contacted with the second phase. For instance, the melting points of the two phases are preferably selected such that a solid second phase may be pushed into a molten first phase without significant melting and concomitant deformation of the second phase. As another example, the melting points are preferably selected such that a molten first phase may be poured onto a solid second phase without significant melting and concomitant deformation of the second phase. This preferred embodiment may typically be achieved when the second phase has a melting point that is greater than or about equal to the melting point of the first phase.

Non-identical melting points for first and second phases having the same solvent and gellant may be achieved by placing differing relative amounts of solvent and gellant in each phase. For instance, the first phase may contain a first concentration of a first gellant in a first solvent, while the second phase contains a second concentration of a second gellant in a second solvent, where the first and second gellants are identical and the first and second solvents are identical but where the first and second concentrations are non-identical. In one embodiment, the first concentration of gellant is less than the second concentration of gellant. In a further embodiment, ETPA is the gellant in both phases.

In a preferred embodiment, the first phase has a first melting point, the second phase has a second melting point, and the second melting point is greater than or about equal to the first melting point. This distinction in melting points may be achieved even though the first and second phases contain the same solvent(s) and the same gellant(s), as explained above. Alternatively, the first and second phases may contain non-identical solvents and/or non-identical gellants. In one aspect, the invention provides a candle wherein the first phase has a first concentration of a first gellant in a first solvent, and the second phase has a second concentration of a second gellant in a second solvent. The first concentration of gellant may be greater than the second concentration of gellant, or the second concentration may be greater than the first concentration. In a preferred embodiment, the first melting point is between 90° F. and 200° F.

In order to determine the melting point of a gel, a thermometer is placed within the molten composition that, upon cooling, forms the gel. The thermometer is used to gently stir the molten composition as it cools. The temperature displayed by the thermometer is monitored, and the temperature at which the mixture is no longer fluid, i.e., the mixture has solidified to a gel consistency, is denoted as the "Melting Point", which can be measured in either ° F. or ° C. In other instances, for example with a wax, the melting point may be specified by the manufacturer, or it may be determined as for a gel as described previously, or it may be measured in a capillary melting point apparatus.

In one embodiment, the second phase is encased by and preferably directly contacts the first phase. For instance, the first phase may form the body of the candle, and the second phase(s) is/are suspended in the first phase. The second phase may be, for example, in the shape of a heart, or a sphere, or any other shape. A plurality of second phases, of identical or non-identical shape(s), may be suspended within the first phase. In order to create such a mixture, the present invention provides for second phase(s) having a melting point about equal to or greater than the first phase, as explained above. This distinction in melting points is advantageous in forming a candle of the present invention.

For example, some first phase may be poured, while molten, into a mold or other container. One or more second phase(s), already in the desired shape(s), is/are then added to the first phase. The first phase may be fluid or gelled when the second phase is added to it. If the first phase is fluid, then the second phase(s) may be pushed into the first phase and be partially or fully encased by the first phase. If the first phase is gelled, then the second phase(s) will sit on top of the first phase. In either event, it is preferred according to the present invention that the melting point of the second phase(s) be greater than, or about equal to, the melting point of the first phase.

When the second phase(s) have a melting point about equal to or greater than the melting point of the first phase, then the second phase(s) can be brought into contact with first phase at a temperature such that the first phase is molten, but the second phase will retain its shape. That is, the second phase will not substantially melt and deform upon being contacted with molten first composition. Preferably, the second phase has a melting point that is greater than the melting point of the first phase, so the second phase is better able to withstand the effect of being subjected to the temperature at which the first phase is molten. However, even when the first and second phases have similar melting points, so long as the first phase has been allowed to cool to just above its melting point, one or more pieces of second phase may be inserted into molten first phase without noticeably causing the second phase(s) to loose their shape. However, when the melting point of the first phase is significantly above the melting point of the second phase, then it is difficult to suspend second phase in first phase without noticeable deformation of the pieces of second phase. Preferably, the second phase should have a melting point no less than 20° F. below the melting point of the first phase, and more preferably has a melting point in excess of the melting point of the first phase.

When the second phase has a melting point greater than or about equal to the melting point of the first phase, then pieces of second phase may be pushed into molten second phase, without the pieces of second phase being deformed. In addition, pieces of second phase may be placed within a container, and molten first phase poured into the container such that the pieces of first phase are surrounded by molten first phase. Since the melting point of the second phase(s) is at least about equal to the melting point of the first phase, molten first phase may be combined with the second phase, without the second phase loosing its shape.

Thus, in one aspect, the present invention provides a process for preparing a candle, where the process includes combining a first phase, a second phase, and a wick. In the inventive process, the first phase includes a first gelled fuel, where the first gelled fuel includes a first gellant at a first concentration in a first solvent, and the first gelled fuel has a first melting point. The second phase includes a second gelled fuel, where the second gelled fuel includes a second gellant at a second concentration in a second solvent, and the second gelled fuel has a second melting point. The first and second phases are non-identical.

In another aspect, the present invention provides a process for preparing a candle, where the process includes combining a first phase, a second phase, and a wick. In the inventive process, the first phase includes a first gelled fuel, where the first gelled fuel includes a first gellant at a first concentration in a first solvent, and the first phase has a first melting point. The second phase includes a wax and has a second melting point, wherein a) the second melting point is greater than or about equal to the first melting point, and/or b) the second phase is adjacent to, and not encased by, the first phase.

In another aspect, the present invention provides a process for preparing a candle, where the process includes combining a first phase, a second phase, and a wick. In the inventive process, the first phase includes a first gelled fuel, where the first gelled fuel includes a first gellant at a first concentration in a first solvent, and the first phase has a first melting point. The second phase includes a) decorative items positioned on the surface of the first phase; and/or b) one or more non-flammable items positioned within the first phase.

In another aspect, the present invention provides a process for preparing a solid candle, where the process includes combining a wick, a first phase and a second phase. In the inventive process, the first phase includes a fuel and is substantially clear with a first melting point. The second phase includes a fuel and is visually distinct from the first phase. The second phase has a second melting point, where the second melting point is greater than or about equal to the first melting point.

In preferred embodiments of the above-described processes, the two phases of the composite candle have melting points such that the second phase is not substantially melted upon contact with a first phase, when the first phase is molten and contacted with the second phase. For instance, the melting points of the two phases are preferably selected such that a solid second phase may be pushed into a molten first phase without significant melting and concomitant deformation of the second phase. As another example, the melting points are preferably selected such that a molten first phase may be poured onto a solid second phase without significant melting and concomitant deformation of the second phase. This preferred embodiment may typically be achieved when the second phase has a melting point that is greater than or about equal to the melting point of the first phase.

In the inventive processes described above, when the second phase(s) have a melting point about equal to or greater than the melting point of the first phase, then the second phase(s) can be brought into contact with first phase at a temperature such that the first phase is molten, but the second phase will retain its shape. That is, the second phase will not substantially melt and deform upon being contacted with molten first composition.

Preferably, the second phase has a melting point that is greater than the melting point of the first phase, so the second phase is better able to withstand the effect of being subjected to the temperature at which the first phase is molten. However, even when the first and second phases have similar melting points, so long as the first phase has been allowed to cool to just above its melting point (e.g., within about 30° C. of its melting point, preferably within about 20° C. of its melting point, more preferably within about 10° C. of its melting point, still more preferably within about 5° C. of its melting point) one or more pieces of second phase may be inserted into molten first phase without noticeably causing the second phase(s) to loose their shape. However, when the melting point of the first phase is significantly above the melting point of the second phase (for example, more than about 30° C. above the melting point of the second phase), then it is difficult to suspend second phase in first phase without noticeable deformation of the pieces of second phase. Preferably, the second phase should have a melting point no less than 20° F. below the melting point of the first phase, and more preferably has a melting point in excess of the melting point of the first phase.

In the inventive processes described above, when the second phase has a melting point greater than or about equal to the melting point of the first phase, then pieces of second phase may be pushed into molten second phase, without the pieces of second phase being deformed. In addition, pieces of second phase may be placed within a container, and molten first phase poured into the container such that the pieces of first phase are surrounded by molten first phase. Since the melting point of the second phase(s) is at least about equal to the melting point of the first phase, molten first phase may be combined with the second phase, without the second phase loosing its shape.

The candles of the present invention may be freestanding or placed partially or fully within a container. Particularly when the candle is freestanding, the candle may be encased within a substantially clear coating, that is, the coating forms the exterior-most surface of the candle, and is the part of the candle that is contacted when the candle is handled by the consumer. The coating is typically quite thin, that is, on the order of a few millimeters thick. The coating is preferably "hard" and does not readily crack or otherwise deform when the coated candle is held by the consumer. The coating is preferably high melting, so that the warmth of a consumer's hand will not appreciably soften the coating.

In one embodiment, the candles of the present invention contain a coating. In one aspect of this embodiment, the coating encases the second phase, and the first phase encases the coated second phase. For instance, the first phase may be colorless and transparent, and form the body of the candle. The second phase may be colored, and may or may not be transparent. The second phase will be encased within and visible through the clear first phase. As an illustration, the second phase may be in the shape of a red cherry, but any other color(s) and shape(s) are suitable. The second phase may be suspended within the first phase, and there may be several second phases within the first phase.

One problem with suspending colorful second phases within a colorless and transparent first phase is that the color from the second phase(s) gradually disperses into the first phase, to the detriment of the aesthetic qualities of the candle. To solve this problem, the present invention places a colorless and transparent coating around the second phase(s).

In a preferred embodiment, the coating is, or includes, thermoplastic polymer. A preferred thermoplastic polymer is a polyamide formed from dimer acid and diamine, and possibly optional components. The dimer acid-containing (or "dimer-based") polyamides are commercially available from many sources, including International Paper Company (Purchase, N.Y.) under the UNI-REZ trademark, and Henkel Corporation, Ambler, Pa. under the MACROMELT trademark. These polyamides have been sold commercially for about 50 years, and thus are well known in the art.

A low molecular weight dimer-based polyamide is a preferred coating component, and is more preferably the only component of the coating. Such low molecular weight polyamides are preferred because they typically achieve a low viscosity molten state at a relatively lower temperature than may be achieved from high molecular weight polyamides. In addition, the solubility of a dimer-based polyamide in an organic solvent typically increases as the molecular weight of the polyamide decreases. However, polyamides tend to become more brittle as their molecular weight decreases, and so a balance between brittleness and melt viscosity/solubility properties is preferably attained. UNI-REZ™ 2620 polyamide resin (International Paper, Purchase N.Y.) at 20–40% solids in n-propanol is a suitable solution from which to form a coating on a gelled article of the invention. Such a solution may be applied to the gelled body at room temperature or slightly above room temperature, for example at 30–40° C.

The thermoplastic need not be a polyamide. Another suitable thermoplastic is a styrene-acrylic resin. Styrene-acrylic resins are commercially available and are used in applications such as inks and floor polishes. S. C. Johnson (Racine, Wis.), Air Products (Allentown, Pa.) and Rohm and Haas (Philadelphia, Pa.) are three of the many commercial suppliers of styrene-acrylic resins. Again, a resin with a relatively low molecular weight is preferred, as it allows for a lower viscosity in a low temperature molten state, and generally has higher solubility in organic solvents.

In another preferred embodiment, the coating may include a thermoset. However, the thermoset needs to have a sufficiently long pot life to enable the coating to be applied to the gelled body before the coating cures. The thermosetting system may be a two component system that is cured by mixing two reactive species such as an epoxy cured with a polyamine or polyamide. Alternatively, the thermoset may be a one component system that is cured by water vapor (e.g., a moisture-curable urethane) or electromagnetic radiation (e.g., a UV-curable acrylate or polyamide, etc.), to name two preferred one component thermosets characterized by their curing agent.

Additional polymers from which a suitable coating for the gelled article of the invention may be formed include, without limitation, polyolefins, polydienes, polyamides, polyurethanes, polyimides, polyesters, polyamide-imides, polyester-imides, polyester-amides, polyketones, polyvinyl acetals, polyvinyl ethers, polyureas, acrylics, alkyds, amino resins, cellulosics, elastomers, epoxies, fluoropolymers, ionomers, maleics, natural resins, oleoresinous varnishes, petroleum resins, phenolics, pine derived resins, Shellac, silicones, styrene resins, vegetable and marine oils, vinyl acetate resins, and vinyl chloride resins.

Any phase of the candle, and particularly a gel phase, may be encased in whole or part by a solid coating. As used herein, the term encased means "covered by", so that a phase at least partially encased by a coating has a coating overlying at least some of the phase. The coating preferably directly contacts the exterior surface(s) of the phase. When placed on the exterior of the candle, the coating may confer one or more of a number of possible benefits to the candle. The advantages of placing a hard coating on the exterior surface (s) of a gelled candle, and coatings suitable for this purpose, are set forth in PCT International Publication No. WO 98/17243.

The coating thus preferably directly contacts the exterior surface of the encased gel. Where the gel phase has a top, a bottom and one or more sides, the coating preferably covers all of the sides of the gel, and optionally the top and bottom. The coating should conform to the exterior surface of the gel, in that the coating is in direct contact with all of the surface that is covered by the coating.

The candles of the present invention may or may not include a solid coating. However, when present, the solid coating may additionally contain one or more (e.g., two, three, etc.) of fragrance, insect-repellent, UV-inhibitor and anti-oxidant. Also, the solid coating may contain a pattern, e.g., a relief image, which adds to the aesthetic appeal of the coated article.

The coating may be used as a barrier to migration of the colorant(s) from the second to the first phase. More generally, the coating serves to retain color within the phase that has been coated. The coating performs this function when the colorant(s) is insoluble, or at least not very soluble, in the coating. So long as the colorant is less soluble in the coating than it is in the second phase, the coating will impede the migration of colorant from the second to the first phases.

Coating compositions that have been described previously in connection with coating the exterior surface(s) of a candle, are also suitably employed to encase a second phase and retain coloration therein. Of course, some coating materials may be somewhat better at retaining coloration within a second phase, and other coating materials may be somewhat better at providing a hard exterior surface for a candle. One of ordinary skill in the art can readily optimize, without undue experimentation, coatings for retaining coloration, and for providing a hard exterior surface to a coating. UNI-REZ™ 2620 resin from International Paper Company (Purchase, N.Y.) is suitable for both types of coating. A plurality of coated second phases may be suspended within a clear first phase, according to the present invention.

In one embodiment, the second phase is visually distinct from the first phase. That is, the consumer can, with the unaided eye, discern at least two different phases (i.e., compositions, regions, areas) that form the candle. For instance, the first phase may be a colorless, transparent matrix, within which is suspended one or more second phases, where the second phases will be colored and/or opaque/translucent. Multiple and distinct second phases may be suspended within the first phase, where the second phases may have the appearance of pieces of cut melon, or hearts, or any other visually interesting shape. Thus, in a preferred embodiment, the second phase is encased by, yet is visible through, the first phase. In another embodiment, the two phases are adjacent to one another. For instance, the entire candle may have a pillar shape, however the pillar is formed from layers of various appearances. For example, the bottom half of the pillar may have a first appearance, and the top half of the pillar may have a second appearance.

In one approach according to the present invention, the second phase (but not the first phase) contains opacifying agent and gellant. Suitable opacifying agents include paraffin, titanium dioxide, pearlescent agent, pigment, dye, zinc oxide, wax, solid fatty acid, solid fatty alcohol, and opacifying resin.

The first and second phases may be advantageously combined even though the second phase is not encased within the first phase. For example, it is typically the case that as the ratio of gellant to solvent increases, the gel develops a "harder" consistency (although, typically, there is a point beyond which increasing the gellant/solvent ratio does not have much effect on gel consistency). For many applications, it is desirable that the gel have a hard consistency, i.e., it not be easily deformed by the application of pressure. A hard gel will resist penetration by, for example, a finger, better than will a soft gel. However, gellant is typically more expensive than solvent, and so harder gels typically cost more to manufacture than soft gels.

According to the present invention, an open-topped container is filled to near its top with a first phase having a first weight ratio of gellant to solvent. The top of the container is filled with a second phase having a second weight ratio of gellant to solvent. The second phase has a weight ratio of gellant to solvent such that the second phase has a "hard" gel consistency. The underlying first phase, since the consumer does not directly contact it, may have a weight ratio of gellant to solvent that affords a "soft" gel consistency. In this way, the second phase serves as a cap over the first phase. The cap contains a relatively high gellant concentration, while the underlying first phase contains a relatively low gellant concentration. The cap is not necessarily visually distinct from the underlying phase.

When ETPA is the gellant, and mineral oil is the solvent, the cap (i.e., the second phase) preferably has a gellant concentration within the range of 20–50 wt %, more preferably about 25–45 wt %, still more preferably about 30–40 wt %. The underlying first phase may have a gellant concentration with the range of 5–35 wt %, preferably within the range of 10–30 wt %, more preferably within the range of 15–25 wt %. These weight percent values are based on the weight of gellant in the total weight of gellant and solvent. Of course, the underlying first phase may have a gellant concentration equal to, or even greater than the gellant concentration in the cap, however, there is little economic incentive to prepare such a composite. Alternatively, the chemical identities of the gellant(s) and/or solvent(s) in the first phase may be different from those in the second phase. For instance, the first phase may contain polyamide as the gellant, while the second phase contains block copolymer as the gellant.

In another embodiment, the first and second phases of the candle each contain gellant, however the first or second phase contains one or more components not present in the other phase. In a preferred aspect, a phase contains one or more components that affects the properties of the phase, so that the phase has properties that is/are distinct from properties of the other phase. In a further preferred aspect, the second phase contains one or more components that impact the visual appearance of the second phase, and renders the first and second phases visually distinct from one another.

For example, the second phase may contain a component that enhances, or retards the burning rate of the second phase, relative to the burning rate of the first phase. For instance, flammable solvent may be added to the second phase, to enhance the burning rate of the first phase. Suitable burn rate-enhancing flammable solvents are solvents having flash points greater than the flash point(s) of the solvents present in the first phase.

As another example, the second phase may contain one or more components that render the second phase visually distinct from the first phase. For instance, the second phase may contain coloration not present in the first phase. Such an example includes candles wherein the second phase is colored and the first phase is colorless. The second phase may be a colored (e.g., blue, red, green, etc.) geometric shape (e.g., cube, sphere, rod, and fruit-shape), suspended within a first phase that is a colorless gel matrix. Of course, the candle may include multiple and distinct second phases, each distinct second phase having a particular coloration and shape, where these second phases are distinct from one another and from the first phase, and the second phases are suspended within the first phase, where the first phase is a continuous gel matrix. The second phases may, or may not, be coated in a manner that retains coloration within the second phases.

As another example, the second phase may contain an opacifying agent that is not present in the first phase. The opacifying agent renders the second phase partially or completely opaque, so that one cannot see through the second phase. In addition, the opacifying agent may impart coloration to the second phase. Suitable opacifying agents include wax (e.g., paraffin wax), metal oxide (e.g., zinc oxide, titanium oxide, etc.), pearlescent agent (e.g., glyceryl monostearate, other pearlescent agents are available from J. H. Hinz Specialty Chemicals (Westlake, Ohio, www.jhhniz-.com), EM Industries, Inc. (Hawthorne, N.Y.; www.em-science.com) and www.craftcave.com), pigment or dye, opacifying resin/agent (e.g., ozokerite, silica, zinc oxide, titanium oxide, ester of ethylene glycol with stearine), and solid fatty acids and fatty alcohols, that is, an organic molecule that is a solid a room temperature and which has at least one carboxylic acid (—COOH) or hydroxyl (—OH) group (e.g., stearic acid, stearyl alcohol).

As yet another example, the second phase may contain a decorative item, also known as an icon, which is not present in the first phase. The icon imparts a visually interesting feature to the candle. Suitable icons include seashells, pieces of glass (e.g., marbles, sea glass), pieces of metal (e.g., glitter), and botonicals (e.g., leaves, seeds, pieces of wood), to name a few.

In this embodiment, certain decorative item(s) will be present in the second phase but not in the first phase. Accordingly, the candle will not only contain decorative items that enhance the appearance of the candle, but those decorative items will be positioned within the candle at locations such that certain region(s) of the candle will contain the decorative item(s), and certain region(s) will not contain the item(s). This non-uniformity in the distribution of the decorative item(s) further enhances the visual appeal of the candle.

Furthermore, non-flammable decorative items may be placed into a phase that is not in immediate contact with a wick. For example, a candle may be formed of an interior cylinder encased by a thick outer layer. The thick outer layer may be the second phase, which contains the decorative items, where the decorative items may, or may not, be flammable. The interior cylinder may be the first phase, which contains only flammable materials. The wick of the candle may be imbedded solely in the first phase. Upon burning, the interior of the candle will burn, leaving the exterior of the candle non-molten.

When the second phase is transparent, the light of the burning candle may be seen through the second phase, which will enhance the appearance of the decorative items suspended in the second phase. Accordingly, the non-uniformity in the distribution of the decorative items may also affect the burning of the candle.

In any of the candles of the present invention, a desirable optional component is a fragrance. The term "fragrance" is intended to refer to a chemical or blend of chemicals that together have a desirable odor. Fragrances typically consist of a blend of chemicals, fragrant chemicals or fragrance materials. A large number of fragrance materials are known and used in various products such as perfumes, cosmetics, soaps, detergents, etc. Any of the fragrance materials used in these products may be added to a gel of the present invention. Suitable fragrances are set forth in PCT International Application No. PCT/US97/18821 (see, e.g., Example 35 therein). Bush Boake Allen of Montvale, N.J. sells a large number of fragrance raw materials. These fragrance raw materials may be combined in numerous ways to create pleasing fragrances for candles disclosed herein.

The amount of fragrance that should be present in the candle will depend on the intensity of the fragrance and the degree to which it is desired that the gel emit fragrance. This amount can be readily determined by the skilled artisan, with little or no experimentation. An amount of fragrance equal to at least about 0.1 wt %, based on the total weight of the composition, is typically necessary in order to achieve at least some fragrance-emitting character for the composition. Typically, a fragrance amount of less than about 50 wt % (based on the total weight of the candle) is satisfactory, and often an amount of less than 20 wt % or even less than 15 wt % is satisfactory. In a typical gel having fragrance, the fragrance constitutes about 1–5 wt % of the total weight of the gel.

The amount of fragrance in a candle may depend upon the presence of other optional ingredients. For example, if insect repellent is also present in the candle, the fragrance concentration is typically less than 30 wt % of the total weight of the gel, and preferably is about 1–5 wt. %.

The fragrance may be mixed together with the solvent and gellant at any time prior to formation of the gel. However since many fragrance materials are rather volatile, it is preferred to add the fragrance to the ungelled composition at a relatively low temperature rather than a high temperature. A temperature of about 80° C. is typically suitable for adding the fragrance to the gel.

A clarifying agent is another optional ingredient that may be present in a first or second phase. The presence of the clarifying agent allows the first and/or second phase to have, or retain, a substantially clear appearance. For example, in some instances, first and/or second phase that has become molten due to lighting the candle, will not retain a substantially clear appearance absent clarifying agent. Suitable clarifying agents include $C_{10}$–$C_{22}$monocarboxylic acids and alkylene glycol. A suitable monocarboxylic acid is myrstic acid and a suitable alkylene glycol is hexylene glycol.

When preparing a candle or fuel, other optional ingredients, such as colorant, fragrance, insect repellent, insecticide, and/or preservative (for example, antioxidant and/or UV-inhibitors), may be added at any time prior to formation of the gel structure. For example, they may be added after the gellant and solvent have formed a homogeneous mixture. Alternatively, they may be added prior to the formation of a homogeneous mixture.

The preservative, which may be an antioxidant and/or a UV-inhibitor, should be present in an amount effective to achieve its or their desired purposes. Typically, at least about 0.1 wt. % of one or both of an antioxidant and UV inhibitor will be present in a candle of the invention. Suitable antioxidants and UV-inhibitors are well known in the art, and include, without limitation, hydroxyditoluene, stearic hydrazide, 2,6-di-tert-butyl-4-methylphenol (BHT, an antioxidant), IRGANOX™ 1010 hindered phenol antioxidant from Ciba-Geigy (Hawthorne, N.Y.) and UVINUL™ 3206 UV-inhibitor from BASF, Parsippany, N.J.

The colorant may, for example, be a pigment or a dye, however a dye is preferred for providing transparent articles. Dyes that are oil soluble are particularly well suited. Oil soluble dyes are well known in the art, and may be obtained from, for example, Pylam Products, Tempe Arizona. Pylam Products sells the following oil soluble dyes: D&C violet #2, D&C yellow #11, D&C green #6, D&C red #17, PYLAKROME™ red dye, PYLAKROME™ brilliant blue dye, PYLA-WAX™ brilliant blue dye, PYLA-WAX™ canary yellow dye, PYLA-WAX™ violet A dye, and PYLA-WAX™ brilliant red dye, among others.

The amount of dye that should be present in the gel will depend on the intensity of the dye and the desired strength of the coloration of the gel. This amount can be readily determined by the skilled artisan, with little or no experimentation. Typically, a colorant amount of less than about 1 wt. % (based on the total weight of the gel) is satisfactory, and often an amount of less than about 0.5 wt. % or less than about 0.25 wt. % is satisfactory. The colorant may be mixed together with the solvent and gellant at any time prior to, or during, formation of the gel.

The following examples are set forth as a means of illustrating the present invention and are not to be construed as a limitation thereon.

In the following Examples, softening point was measured using a Model FP83HT Dropping Point Cell from Mettler Instruments Corporation, with a heating rate of 1.5° C./min. Viscosity measurements were made using a Model RVTD Digital Viscometer from Brookfield Engineering Laboratories, Inc., and are reported in centipoise (cP). Gel clarity and hardness were both judged qualitatively.

In the Examples that follow, and unless otherwise noted, the chemicals were of reagent grade as obtained from commercial supply houses including Aldrich Chemical Co. (Milwaukee, Wis.) and the like. ETPA was prepared according to procedures described in U.S. Pat. No. 5,783,657. UNICLEAR™ 80 resin is an EPTA resin commercially available from International Paper Company (Purchase, N.Y.). DRAKEOL™ 7 is a white mineral oil from the Penreco division (Karns City, Pa.; www.chemexpo.com/show/exhibitorhall/penreco) of Pennzoil-Quaker State Company (Houston, Tex.; www.pennzoil-quakerstate.com). NEOBEE™ M5 is caprylic/capric triglyceride from Stepan Company (Northfield, Ill.; www.stepan.com). As used herein, "BBA" stands for the company Bush Boake Allen (Montvale, N.J.).

EXAMPLES

Example 1

ETPA Gel Compositions

Seventeen mixtures containing UNICLEAR™ 80 resin were prepared, as set forth in Tables 1A and 1B. To prepare each mixture, the indicated ingredients were combined in the indicated amounts (amounts are parts by weight) and heated with stirring until a homogeneous molten mixture resulted. A thermometer was placed into each molten mixture, and the mixture was allowed to cool while monitoring the temperature. The temperature at which the mixture was no longer fluid, i.e., it had solidified to a gel consistency, is denoted as the "Melting Point", as measured in ° F. The melting point of a mixture varied depending on the identity and quantity of the components in the mixture. Each of these mixtures could be used to form a candle according to the present invention.

In general, as the concentration of UNICLEAR™ 80 resin increased, the mixture displayed reduced softness and increased melting temperature. At a UNICLEAR™ 80 resin concentration of about 18 parts by weight in 100 parts mixture, the mixture displayed little or no softness at room temperature. Without hexylene glycol, a mixture tended to develop a hazy or opaque appearance when the mixture was cooled to below 32° F. and/or warmed to room temperature after having been at a temperature below 32° F. The presence of myrstic acid enhanced the clarity of a mixture and/or the clarity of the liquid pool that formed upon melting a candle formed from a mixture.

Each of mixtures 1–17 is colorless and substantially clear. To impart color to any of the mixtures 1–17, an oil-soluble dye can be added to the molten form of the mixture. Oil soluble dyes are well known in the art, and may be obtained from, for example, Pylam Products, Tempe Ariz. Conveniently, the dye is dissolved in mineral oil or isocetyl alcohol at a concentration of about 2 wt %, and then about 1 wt % of this colored oil is added to the UNICLEAR™ 80 resin-containing mixture.

TABLE 1

UNICLEAR ™ 80 RESIN MIXTURES 1–17

| | Mixture Number | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 |
| UNICLEAR ™ 80 | 10 | 10 | 10 | 12 | 12 | 12 | 12 | 14 | 14 | 14 | 14 | 16 | 18 | 16 | 16 | 18 | 18 |
| Myrstic Acid | 4 | 4 | 5 | 8.5 | 4 | 4 | 5 | 4 | 7 | 7 | 6 | 6 | 5 | 6 | 6 | 4 | 5 |
| Hexylene Glycol | 5 | 6 | 5 | 0 | 4 | 5 | 2 | 6 | 0 | 2 | 3 | 3 | 3 | 2 | 3 | 3 | 3 |
| DRAKEOL ™ 7 | 81 | 80 | 80 | 95 | 95 | 95 | 95 | 95 | 95 | 95 | 95 | 70 | 69 | 76 | 75 | 69 | 69 |
| Fragrance | 0 | 0 | 0 | 0 | 0 | 0 | 0 | 0 | 0 | 0 | 0 | 5 | 5 | 0 | 0 | 5 | 5 |
| Melting Point (° F.) | 98 | 95 | 98 | 100 | 98 | 95 | 98 | 105 | 110 | 108 | 110 | 105 | 115 | 110 | 105 | 115 | 115 |
| Appearance | C | T | T | C | H | H | C | T | C | T | T | T | T | ND | ND | ND | ND |
| Softness | So | So | So | ND | ND | ND | ND | ND | ND | ND | ND | ND | ND | ND | ND | ND | ND |

C = cloudy; H = hazy; ND = not determined; So = some; T = transparent/clear;

Example 2

ETPA-Wax Blend

This example illustrates a composition according to the present invention that includes gellant (ETPA), solvent for the gellant (mineral oil), and wax (paraffin wax), where the composition is homogeneous on a macroscopic scale.

A molten blend containing 40 parts ETPA, 37 parts mineral oil, 18 parts paraffin wax (melting point=135° F.) and 5 parts fragrance was prepared (all parts being by weight). With stirring, the blend became homogeneous. Upon cooling, the blend had a translucent white appearance. In combination with a wick, this blend could be used to form either a free-standing pillar candle, or a candle positioned within a container. The blend could also be poured into molds without a wick, to thereby form decorative items such as hearts, cubes, etc., depending on the shape of the mold. Colorant could be added to the molten blend, so that the cooled blend had a translucent colored appearance. The decorative items could be positioned within an ETPA gel candle to afford a very defined appearance as seen through the transparent ETPA gel.

Example 3

Container Cap Composition

Depending on the precise composition, some ETPA gels exhibit softness. When the ETPA gel is placed within a container, the container provides a barrier between the gel and the environment, so that any softness that may occur will not be felt by the person handling the contained candle. However, containers are typically open at their top, so that softness occurring at the top of the gel may be noticed by the candle consumer.

The extent to which an ETPA gel displays softness is dependent, in part, on the concentration of ETPA in the gel. As the concentration of ETPA in the gel increases, softness decreases. Upon reaching an ETPA concentration of about 30–35 wt %, an ETPA gel typically displays essentially no softness.

Generally, ETPA is more expensive than mineral oil. In order to reduce the cost of an ETPA gel candle, and therefore encourage its commercial acceptance, it is desirable to reduce the relative proportion of ETPA to mineral oil in the candle, i.e., to use less ETPA and more mineral oil in the formulation. The use of less ETPA in the gel however allows for increased softness.

This example illustrates a candle according to the present invention that includes a wick, a first phase and a second phase, where the first phase includes a first gelled fuel, and the first gelled fuel includes a first gellant at a first concentration in a first solvent. The second phase includes a second gelled fuel, where the second gelled fuel includes a second gellant at a second concentration in a second solvent. The first and second concentrations are non-identical. Thus, and in the context of a contained ETPA candle, in order to minimize the cost of the candle and eliminate the perception of softness, a two-phase candle may be prepared. The majority of the two-phase candle contains a low ETPA/mineral oil ratio, but the top of the candle contains a high ETPA/mineral oil ratio.

To prepare such a candle, a container is filled, to approximately 90% of its volume, with a blend containing 18 parts UNICLEAR™ 80 resin, 3 parts hexylene glycol, 5 parts myrstic acid, 69 parts DRAKEOL™ 7 mineral oil, and 5 parts fragrance. After this blend has developed a gel consistency, the remainder of the container's volume is filled with a blend containing 30–35 wt % UNICLEAR™ 80 resin according to either blend number 1 or 2 in Table 2.

In this way, the container is 'capped' with a layer of ETPA gel that does not exhibit softness. Taking this approach a step further, the ETPA concentration in the ETPA gel underlying the cap can be reduced to a level that demonstrates somewhat severe softness, but because of the cap, this softness will not be noticed by the consumer. In this way, the overall candle contains a relatively high proportion of mineral oil, and accordingly is relatively less expensive, but does not exhibit noticeable softness.

TABLE 2

| Mixture No. | 18 | 19 |
|---|---|---|
| UNICLEAR ™ 80 | 30 | 35 |
| DRAKEOL ™ 7 | 36 | 31 |
| NEOBEE ™ M5 | 25 | 25 |
| Myrstic Acid | 2 | 2 |
| Hexylene Glycol | 2 | 2 |
| Fragrance | 5 | 5 |
| Melting Point (° C.) | 70 | 73 |

Example 4

Chunk Candle

A molten blend of 95 parts paraffin wax (melting point 135° F.) 5 parts fragrance and 0.5 parts oil soluble dye is prepared, and allowed to cool within molds that imitate the shape of cut wedges.

A container is then filled, to about ⅓ capacity, with a molten blend of 18 parts UNICLEAR™ 80 resin, 3 parts hexylene glycol, 5 parts myrstic acid, 69 parts DRAKEOL™ 7 mineral oil, and 5 parts fragrance; this blend has a melting point of 115° F. A wick is also placed in the container. When the UNICLEAR™ 80 resin blend cools and achieves a viscous consistency, pieces of the wax wedges are placed on top of, and slightly embedded into, this layer of UNICLEAR™ 80 resin blend. After the UNICLEAR™ 80 resin blend cools to a gel consistency, additional molten UNICLEAR™ 80 resin blend is added to fill the container to about ⅔ of its total capacity, followed by the addition of more wax wedges. Additional molten UNICLEAR™ 80 resin blend is then added to the container, in order to fill the container to about 90–95% of its total capacity. Some additional wedges are embedded in this lastly added UNICLEAR™ 80 resin blend. The remaining top ca. 5–10% of the container's capacity is filled with a molten 'capping' layer that contains 35 parts UNICLEAR™ 80 resin, 31 parts DRAKEOL™ 7 mineral oil, 25 parts NEOBEE™ M5 triglyceride, 2 parts myrstic acid, 2 parts hexylene glycol, and 5 parts fragrance.

Upon complete cooling, the candle has the appearance of chunks or wedges suspended within a transparent matrix.

The candle of Example 4 illustrates a candle that includes a wick, a first phase and a second phase, where the first phase includes a first gelled fuel, and the first gelled fuel includes a first gellant at a first concentration in a first solvent, the first phase having a first melting point. The candle also includes a second phase that includes wax, where the second phase has a second melting point. The second melting point is greater than or about equal to the first melting point.

In a related embodiment, the pieces of wax wedges are coated with a polymeric coating, for example, UNI-REZ™ 2620 polyamide resin, which causes the coloration within the wax to stay in the wax rather than diffuse into the UNICLEAR™ 80 resin blend. The use of the polymeric coating is particularly desirable when the wax wedge is intensely colored, i.e., contains a relatively large amount of dye.

Example 5

Bilayer Candle Having Interior Core for Burning and Outer Decorative Layer

"Blend 1" was prepared from 50.0 parts ETPA, 45.0 parts DRAKEOL™ 7 mineral oil, and 5.0 parts fragrance (BBA Product No. 564-24392). Blend 1 was heated with stirring until homogeneous, then poured into a cylindrical mold having a 2.5 inch diameter. The mold contained a wick along the central axis of the cylinder. After cooling, blend 1 was transparent and formed a candle.

The candle formed from blend 1 was placed, standing up, in the middle of a cylindrical mold having a diameter of about 4 inches. Additional molten blend 1 was poured into the space between the candle and the side of the 4 inch diameter mold. Some dried leaves and other dried botonicals (e.g., flowers) were placed into the cooling blend 1, so that the leaves and dried botonicals were suspended within the cooled blend 1, and together with the blend 1 formed a decorative layer around the central candle.

In this way, a 4-inch diameter, two phase candle was prepared, where the central 2.5 inch diameter of the candle contained a wick and no decorative items, and the exterior 1.5 inch diameter of the candle contained decorative items suspended within the ETPA/DRAKEOL™ gel. Upon lighting, the central candle burned, leaving the exterior 1.5 inch of the candle largely unchanged. The light of the burning candle could be seen through the surrounding decorative layer, and provided a pleasing appearance.

Example 5 illustrates a candle that includes a wick, a first phase and a second phase. The first phase includes a first gelled fuel, where the first gelled fuel includes a first gellant at a first concentration in a first solvent. The first gelled fuel has a first melting point. The second phase includes a second gelled fuel, where the second gelled fuel includes a second gellant at a second concentration in a second solvent. The second gelled fuel has a second melting point. The first and second phases are non-identical in that one phase contains botanicals.

Example 6

Transparent Candle Having Decorative Items Suspended Within

A blend, denoted blend 2, was prepared from 18.75 parts ETPA, 46.25 parts mineral oil, 25.0 parts NEOBEE™ M5, 5.0 parts myrstic acid, and 5.0 parts fragrance (BBA Product No. 351-27689). Blend 2 was heated with stirring until homogeneous. Sufficient molten blend 2 was poured into a transparent container in order to fill about ⅓ of the container's volume. A wick was placed into the center of the molten blend 2.

Some glass beads (e.g., marbles) were placed on top of the cooling blend 2. Depending on the exact consistency of blend 2, the glass beads would remain on top of blend 2 (if blend 2 was largely in the gel form, that is, blend 2 had cooled to, or almost to, room temperature), or would sink to the bottom of blend 2 (if blend 2 was large fluid, that is, it was still hot) or would only partially sink into blend 2 (if blend 2 was just at the gel-forming temperature, that is, it had partially cooled). If the glass beads themselves had various densities, then the beads would sink into blend 2 to different extents, if blend 2 was at a temperature that would permit this discrimination.

After the initially added blend 2 had cooled, further molten blend 2 was added to the container, in an amount sufficient so that the container, in total, was about ⅔ full of blend 2. Additional glass beads were added to this second layer of blend 2, with the results described above, depending on the temperature of the blend 2. After this second layer of blend 2 had substantially cooled, sufficient molten blend 2 was added to fill the container. Additional glass beads were also added to this uppermost layer of blend 2.

Upon cooling to room temperature, the resulting candle contained glass beads suspended in a transparent fuel of mineral oil and ETPA. The beads did not melt at the temperature reached by the burning candle.

This same process can be repeated using a mold for the container, so that after the candle is finally formed, it can be removed from the mold to form a free-standing pillar shape. In this instance, a desirable option is to coat the pillar candle with a polymeric coating. Whether the candle is in a container or free-standing form, glass beads with large surface area are generally preferred.

The candle of Example 6 illustrates a candle that includes a wick, a first phase and a second phase. The first phase includes a first gelled fuel, where the first gelled fuel includes a first gellant at a first concentration in a first solvent. The first phase has a first melting point. The second phase includes one or more non-flammable items positioned within the first phase.

Example 7

Encasing a Substantially Clear Colored Candle Within a Substantially Clear Colorless Candle A molten blend containing 40 wt % ETPA, mineral oil and bright red dye was prepared and allowed to cool in a heart-shaped Distlefink mold (Distlefink Product No. 51307). A cylindrical mold was partially filed with a colorless blend of ETPA and mineral oil, and after the-colorless blend had partly solidified, the red heart was positioned on top of the colorless blend. Additional colorless molten blend was then poured around and on top of the red heart, to fill the container. Upon complete cooling to room temperature, the final product was a transparent red heart encased within a colorless transparent gel. The red heart could be seen within the candle, however, the heart did not have a sharp, well-defined appearance. Also, over several weeks, the red color diffused from the heart and into the formerly colorless outer ETPA layer.

Example 7 illustrates a candle that includes a wick, a first phase and a second phase. The first phase includes a first gelled fuel, where the first gelled fuel includes a first gellant at a first concentration in a first solvent. The first gelled fuel has a first melting point. The second phase includes a second gelled fuel, where the second gelled fuel includes a second gellant at a second concentration in a second solvent. The second gelled fuel has a second melting point. The first and second phases are non-identical.

Example 8

Dispersing Decorative Items Within a Substantially Clear Candle

A molten blend containing ETPA, mineral oil, 0.3% dye (DIC #6) and 5 wt % fragrance (BBA Product No. 126-

29698) was prepared. A container was partially filled with this blend, and after the blend had reached the desired consistency, a small handful of colored seaglass (small pieces of smooth, opaque glass) was placed on top of the blend. The extent to which the seaglass sank into the blend was dependent on the consistency of the blend, that is, the seaglass sank more when the blend was warmer and more fluid, and sank less as the blend cooled and developed more gel character. Preferably, the blend was semi-fluid, so that the seaglass sank somewhat into the blend, the extent depending on the size of the piece of sea glass, and/or its density. Thereafter, additional blend, and then additional seaglass was added successively, until the container was full. A wick was also present within the container, so the final product was a candle.

The pieces of seaglass could be seen through the transparent ETPA gel, and overall the candle had a very pleasing appearance. Example 8 illustrates a candle that includes a wick, a first phase and a second phase. The first phase includes a first gelled fuel, where the first gelled fuel includes a first gellant at a first concentration in a first solvent. The first phase has a first melting point. The second phase includes one or more non-flammable items positioned within the first phase.

Example 9

Dispersing Decorative Items Within a Substantially Clear Candle

A molten blend containing ETPA, mineral oil, between 0.05 and 1 wt % dye solution (the dye solution was a mixture of Pylakrome Bright Blue dissolved in mineral oil at a concentration of 2 wt %) and 5 wt % fragrance (BBA Product No. 126-29698) was prepared. A container was partially filled with this blend, and after the blend had reached a semi-gelled consistency, a few blue glass marbles were added. These marbles sank slightly into the blend. After the first layer of blend had cooled and developed a gel consistency, additional molten blend and marbles were added successively until the container was full. A wick was also placed in the container, in order to form a candle.

The final product was a transparent blue-tinted candle having blue glass marbles visibly suspended within the candle. Example 9 illustrates a candle that includes a wick, a first phase and a second phase. The first phase includes a first gelled fuel, where the first gelled fuel includes a first gellant at a first concentration in a first solvent. The first phase has a first melting point. The second phase includes one or more non-flammable items positioned within the first phase.

Example 10

Paraffin Objects Suspended Within a Substantially Clear Gel Candle

A molten blend containing ETPA, mineral oil, and fragrance (BBA Product No. 571-30853) was prepared. A container was partially filed with this blend, and the blend was allowed to cool until is assumed a gel consistency. Several small wax (paraffin) candles were placed on top of the gel, and then additional molten ETPA blend was poured around, and on top of, the wax candles. Upon cooling, the wax candles were clearly visible within the transparent EPTA gel. Essentially the same process may be followed using colored CRAYONS™ (which are a mixture of wax and colorant) rather than wax candles, in order to provide a candle having CRAYONS™ visibly suspended within the ETPA candle. As another alternative, paraffin wax may be molded into other desirable shapes, e.g., a rose or other flower, and this shape may be suspended within the transparent ETPA gel. The embedded objects are visually distinct from, and have a melting point that is greater than or about equal to the melting point of the surrounding (first) phase.

To some extent, over a period of time, color from the colored paraffin object diffuses into the ETPA gel, which changes the appearance of the initial product. In order to minimize or eliminate this color transfer, the paraffin object may be coated with a transparent polymeric coating, for example, a polyamide coating. The presence of the polyamide coating sharply curtails the diffusion of color from the colored paraffin object to the ETPA gel. UNI-REZ™ 2670 polyamide resin dissolved at 30 wt % concentration in n-propanol provides a satisfactory coating solution, into which the wax article may be dipped in order to place a coating around the article.

Example 10 illustrates a candle that includes a wick, a first phase and a second phase. The first phase includes a first gelled fuel, where the first gelled fuel includes a first gellant at a first concentration in a first solvent. The first phase has a first melting point. The second phase includes wax and has a second melting point. The second melting point is greater than or about equal to the first melting point.

Example 11

Glitter Suspended Within a Substantially Clear Candle

A molten blend containing ETPA and mineral oil was prepared. A container as partially filed with this blend and the blend allowed to cool slightly to achieve a thickened consistency. A teaspoon or less of a mixture of gold and silver glitter was added to the blend, and the glitter was stirred into the blend. Additional blend was added to the container, followed by additional glitter with stirring, successively until the container was full. A wick was also placed into the container, to form a candle. The result was a transparent candle within which glitter was suspended.

Paraffinic objects may be embedded within the glittery gel, during preparation of the candle. For example, paraffinic hearts or candles may be added to the gel, during filing of the container, and after swirling the glitter into the gel. Example 11 illustrates a candle that includes a wick, a first phase and a second phase. The first phase includes a first gelled fuel, where the first gelled fuel includes a first gellant at a first concentration in a first solvent. The first phase has a first melting point. The second phase includes one or more non-flammable items positioned within the first phase.

Example 12

Paraffin Object On Surface Of a Substantially Clear Candle

A molten blend containing ETPA, mineral oil, and fragrance (BBA Product No. 571-30853) was prepared. This blend was poured into a container that also held a wick, in order to form a transparent candle. After the blend had cooled to room temperature and achieved a completely gel consistency, molten white paraffin was dribbled onto the top of the candle. Upon cooling, the paraffin wax has the appearance of whipped cream, and the transparent ETPA candle looks like a parfait, so that the combination resembles a popular dessert. The molten blend containing ETPA can be colored by the addition of an oil soluble dye, so that the parfait has an orange, red, etc. color.

Example 12 is illustrative of a candle that includes a wick, a first phase and a second phase. The first phase includes a first gelled fuel, where the first gelled fuel includes a first gellant at a first concentration in a first solvent. The first phase has a first melting point. The second phase includes wax and has a second melting point. The second melting point is greater than or about equal to the first melting point.

Example 13

Layered Gel/Wax Candle

A molten blend containing ETPA, mineral oil and blue dye was prepared. A second molten blend containing ETPA, mineral oil and red dye was prepared. In addition, paraffin wax was melted. A container or cylindrical mold was filled ⅓ to the top with blue-colored ETPA blend. After this blend had cooled, an equal quantity of white paraffin wax was poured onto the blue gel. After this wax had cooled, an equal quantity of red-colored ETPA blend was poured on top of the white paraffin wax. A wick was positioned within this tri-layered object, to form a candle.

This candle had the red, white and blue colors of the American flag, and thus had a patriotic appearance. The candle of Example 13 is exemplary of a candle that includes a wick, a first phase and a second phase. The first phase includes a first gelled fuel, where the first gelled fuel includes a first gellant at a first concentration in a first solvent. The first gelled fuel has a first melting point. The second phase includes a second gelled fuel, where the second gelled fuel includes a second gellant at a second concentration in a second solvent. The second gelled fuel has a second melting point. The first and second phases are non-identical. This candle is also exemplary of a candle that includes a second phase including wax, the second phase having a second melting point, wherein the second phase is adjacent to, and not encased by, the first phase.

Example 14

Bilayer Candle

A molten blend containing ETPA, mineral oil, and fragrance (BBA Product No. 571-30853) was prepared and allowed to fill ½ of a rectangular mold. The mold was positioned so that the ETPA covered the entire bottom of the mold, but only one edge of the top of the mold, i.e., so that the molten blend formed a triangular structure within the mold. After the molten ETPA had cooled to form a gel, the space remaining in the mold was filled with molten paraffin wax. After the wax had cooled, the final object was rectangular in shape, but appeared to be formed from two triangular pieces.

The candle of Example 14 is exemplary of a candle that includes a wick, a gel phase and a wax phase, where the wax phase is adjacent to, and not encased by, the gel phase. The candle may be prepared from wax and gel having non-identical melting points.

Example 15

Candle With Decorative Surface Features

A molten blend containing ETPA and mineral oil was prepared and poured into a pillar mold containing a wick. After cooling, the ETPA gel was removed from the mold and the exterior surface of the gel was coated with one of the following: glitter, small beads, sugar, white non-sparkling glitter, flower pieces, spices, and decals/pictures. Each of these decorative items adhered to the surface of the candle. Optionally, the entire candle (ETPA gel with decorative surface feature) could be coated with a transparent polymeric coating by, for example, briefly dipping the entire candle into a 30 wt % solution of UNI-REZ™ 2620 polyamide resin dissolved in n-propanol.

The candle of Example 15 comprises a wick, a gel phase, and one or more decorative items, the decorative items positioned on the surface of the gel phase. When the entire candle is coated with UNI-REZ™ 2620, the product is exemplary of a candle comprising a wick, a gel phase, and one or more decorative items, the decorative items positioned on the surface of the gel phase, wherein a polymeric coating covers at least a portion of the candle.

Example 18

Wave Candle

A molten blend containing ETPA and mineral oil was prepared and poured into a container along with a wick. After allowing the ETPA/mineral oil blend to cool slightly and adopt a viscous but not yet gel consistency, molten paraffin was poured into the container. The container was capped and then rolled gently, whereby the paraffin formed wave-like features within the ETPA matrix. Upon complete cooling, the candle looked as though white paraffin wax had been woven into the transparent ETPA matrix.

Depending on the relative melting points of the wax and gel phases, the candle of Example 16 is exemplary of a candle comprising a wick, a first phase (the gel phase) and a second phase (the wax phase), the first phase comprising a fuel and being substantially clear with a first melting point, the second phase comprising a fuel and being visually distinct from the first phase with a second melting point, the second melting point being greater than or about equal to the first melting point; and a solid candle comprising a wick, a first phase (the gel phase) and a second phase (the wax phase), the first phase comprising a fuel and being substantially clear with a first melting point, the second phase comprising a fuel and being visually distinct from the first phase with a second melting point, the first melting point being non-identical to the second melting point.

Throughout the present specification, where gellants or reaction mixtures are described as including or comprising specific components or materials, it is contemplated by the inventors that the gellants or reaction mixtures may alternatively consist essentially of, or consist of, the recited components or materials. Accordingly, throughout the present disclosure any described composition (gellant or reaction mixture) of the present invention can consist essentially of, or consist of, the recited components or materials.

As used herein, the word "a" in association with the word it precedes, e.g., "a solvent" or "a gellant", refers to "one or more". That is "a solvent" may be a mixture of chemicals, each of which could function as a solvent, and that together also functions as a solvent. Likewise, "a gellant" refers to one, or a mixture of two or more gellants. Accordingly, as used herein, the word "a" is not synonymous with the word "one".

All publications and patent applications mentioned in this specification are herein incorporated by reference to the same extent as if each individual publication or patent application was specifically and individually incorporated by reference.

It will be appreciated by those skilled in the art that changes could be made to the embodiments described above without departing from the broad inventive concept thereof. Thus, the present invention includes candles having a wick, a first phase and a second phase, such that in one embodiment, the first phase is substantially clear and has a first melting point, the second phase is visually distinct from the first phase and has a second melting point, and the second melting point is greater than or about equal to the first melting point. In another embodiment, the first phase contains a first concentration of gellant in first solvent, the second phase contains a second concentration of gellant in second solvent, and the first and second concentrations are non-identical. In another embodiment, the first and second phases each contain gellant, however the second phase contains components not present in the first phase. It is understood, therefore, that this invention is not limited to the particular embodiments disclosed, but it is intended to cover modifications within the spirit and scope of the present invention as defined by the appended claims.

What is claimed is:

1. A candle comprising a wick, a first phase and a second phase, wherein the first phase comprises a first gelled fuel, the first gelled fuel comprising a first gellant at a first concentration in a first solvent, the first phase having a first melting point and being capable of functioning as a fuel in a burning candle; and the second phase comprises wax and has a second melting point, wherein a) the second melting point is greater than or about equal to the first melting point, and/or b) the second phase is adjacent to, and not encased by, the first phase.

2. A candle of claim 1 wherein the first gellant is selected from a group consisting of polyamide, polyesteramide, and block copolymer.

3. A candle of claim 1 wherein the first gellant has the formula (1):

(1)

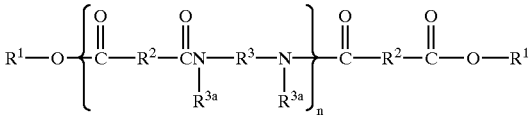

wherein, n designates a number of repeating units such that ester groups constitute from 10% to 50% of the total of the ester and amide groups;

$R^1$ at each occurrence is independently selected from hydrocarbyl groups;

$R^2$ at each occurrence is independently selected from a $C_{2-42}$ hydrocarbon group with the proviso that at least 10% of the $R^2$ groups have 30–42 carbon atoms;

$R^3$ at each occurrence is independently selected from an organic group containing at least two carbon atoms in addition to hydrogen atoms, and optionally containing one or more oxygen and nitrogen atoms; and $R^{3a}$ at each occurrence is independently selected from hydrogen, $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$.

4. A candle of claim 1 wherein the first solvent is selected from a group consisting of mineral oil, fatty acid ester, fatty acid glycol and fatty alcohol.

5. A candle of claim 1 wherein the first gelled fuel is substantially clear.

6. A candle of claim 1 positioned within a container.

7. A candle of claim 1 which is free-standing.

8. A candle of claim 1 having a coating that forms the exterior-most surface of the candle.

9. A candle of claim 8 wherein a coating comprising polyamide forms the exterior-most surface of the candle.

10. A candle of claim 1 comprising fragrance.

11. A candle of claim 1 comprising clarifying agent.

12. A candle of claim 11 comprising clarifying agent selected from $C_{10}$–$C_{22}$monocarboxylic acid or alkylene glycol.

13. A candle of claim 1 comprising an opacifying agent selected from the group consisting of paraffin, titanium dioxide, dye, zinc oxide, wax, solid fatty acid, solid fatty alcohol, and opacifying resin.

14. A candle of wherein the first melting point is between 90° F. and 200° F.

15. A candle of claim 1 wherein the second melting point is greater than the first melting point.

16. A candle of claim 1 wherein the second melting point is within about 30° F. of the first melting point.

17. A candle of claim 1 wherein at least one of the first phase and the second phase contains a decorative item.

18. A candle of claim 1 wherein the first and second phases have melting points such that the second phase can be brought into contact with molten first phase and the second phase will retain its shape.

19. A composition comprising gellant, solvent for the gellant, and wax, the composition being homogeneous on a macroscopic scale.

20. A composition of claim 19, wherein the gellant is selected from a group consisting of polyamide, polyesteramide, and block copolymer.

21. A composition of claim 19, wherein the gellant has the formula (1):

(1)

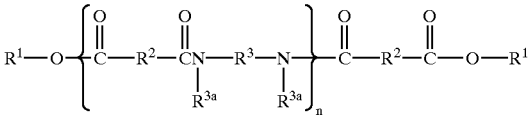

wherein, n designates a number of repeating units such that ester groups constitute from 10% to 50% of the total of the ester and amide groups;

$R^1$ at each occurrence is independently selected from hydrocarbyl groups;

$R^2$ at each occurrence is independently selected from a $C_{2-42}$ hydrocarbon group with the proviso that at least 10% of the $R^2$ groups have 30–42 carbon atoms;

$R^3$ at each occurrence is independently selected from an organic group containing at least two carbon atoms in addition to hydrogen atoms, and optionally containing one or more oxygen and nitrogen atoms; and $R^{3a}$ at each occurrence is independently selected from hydrogen, $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$.

22. A composition of claim 19, wherein the solvent is selected from a group consisting of mineral oil, fatty acid ester and fatty alcohol.

23. A process for preparing a candle, comprising combining a first phase, a second phase, and a wick, wherein the first phase comprises a first gelled fuel, the first gelled fuel comprising a first gellant at a first concentration in a first solvent, the first phase having a first melting point; and the second phase comprises wax and has a second melting point, wherein a) the second melting point is greater than or about equal to the first melting point, and/or b) the second phase is adjacent to, and not encased by, the first phase.

24. A process of claim 23 wherein the first phase comprises gellant selected from a group consisting of polyamide, polyesteramide, and block copolymer.

25. A process of claim 23 wherein the first phase comprises gellant of the formula (1):

(1)

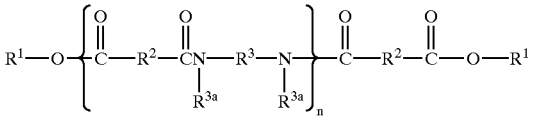

wherein, n designates a number of repeating units such that ester groups constitute from 10% to 50% of the total of the ester and amide groups;

$R^1$ at each occurrence is independently selected from hydrocarbyl groups;

$R^2$ at each occurrence is independently selected from a $C_{2-42}$ hydrocarbon group with the proviso that at least 10% of the $R^2$ groups have 30–42 carbon atoms;

$R^3$ at each occurrence is independently selected from an organic group containing at least two carbon atoms in addition to hydrogen atoms, and optionally containing one or more oxygen and nitrogen atoms; and $R^{3a}$ at each occurrence is independently selected from hydrogen, $C_{1-10}$ alkyl and a direct bond to $R^3$ or another $R^{3a}$ such that the N atom to which $R^3$ and $R^{3a}$ are both bonded is part of a heterocyclic structure defined in part by $R^{3a}$—N—$R^3$.

26. A process of claim 23 wherein the first phase comprises solvent selected from a group consisting of mineral oil, fatty acid ester, fatty acid glycol and fatty alcohol.

27. A process of claim 23 wherein the first phase is substantially clear.

28. A process of claim 23 further comprising placing a coating on a phase of the candle.

29. A process of claim 23 further comprising adding an opacifying agent into a first and/or second phase, the opacifying agent being selected from the group consisting of paraffin, titanium dioxide, dye, zinc oxide, wax, solid fatty acid, solid fatty alcohol, and opacifying resin.

30. A process of claim 23 wherein the first and second phases have melting points such that the second phase can be brought into contact with molten first phase and the second phase will retain its shape.

31. A candle comprising a wick, a first phase and a second phase, wherein the first phase comprises a first gelled fuel, the first gelled fuel comprising a first gellant at a first concentration in a first solvent, the first phase having a first melting point; and the second phase comprises wax and has a second melting point, wherein the second melting point is greater than or about equal to the first melting point.

32. A candle of claim 31 wherein the first solvent is selected from a group consisting of mineral oil, fatty acid ester, fatty acid glycol and fatty alcohol.

33. A candle of claim 31 wherein the first gelled fuel is substantially clear.

34. A candle of claim 31 positioned within a container.

35. A candle of claim 31 which is free-standing.

36. A candle of claim 31 having a coating that forms the exterior-most surface of the candle.

37. A candle of claim 31 wherein a coating comprising polyamide forms the exterior-most surface of the candle.

38. A candle of claim 31 comprising fragrance.

39. A candle of claim 31 comprising clarifying agent.

40. A candle of claim 31 comprising clarifying agent selected from $C_{10}$–$C_{22}$monocarboxylic acid or alkylene glycol.

41. A candle of claim 31 comprising an opacifying agent selected from the group consisting of paraffin, titanium dioxide, dye, zinc oxide, wax, solid fatty acid, solid fatty alcohol, and opacifying resin.

42. A candle of claim 31 wherein the first melting point is between 90° F. and 200° F.

43. A candle of claim 31 wherein the second melting point is greater than the first melting point.

44. A candle of claim 31 wherein the second melting point is within about 30° F. of the first melting point.

45. A candle of claim 31 wherein at least one of the first phase and the second phase contains a decorative item.

46. A candle of claim 31 wherein the first and second phases have melting points such that the second phase can be brought into contact with molten first phase and the second phase will retain its shape.

47. A candle comprising a wick, a first phase and a second phase, wherein the first phase comprises a first gelled fuel, the first gelled fuel comprising a first gellant at a first concentration in a first solvent, the first phase having a first melting point; and the second phase comprises wax and has a second melting point, wherein the second phase is adjacent to, and not encased by, the first phase.

48. A candle of claim 47 wherein the first solvent is selected from a group consisting of mineral oil, fatty acid ester, fatty acid glycol and fatty alcohol.

49. A candle of claim 47 wherein the first gelled fuel is substantially clear.

50. A candle of claim 47 positioned within a container.

51. A candle of claim 47 which is free-standing.

52. A candle of claim 47 having a coating that forms the exterior-most surface of the candle.

53. A candle of claim 47 wherein a coating comprising polyamide forms the exterior-most surface of the candle.

54. A candle of claim 47 comprising fragrance.

55. A candle of claim 47 comprising clarifying agent.

56. A candle of claim 47 comprising clarifying agent selected from $C_{10}$–$C_{22}$monocarboxylic acid or alkylene glycol.

57. A candle of claim 47 comprising an opacifying agent selected from the group consisting of paraffin, titanium dioxide, dye, zinc oxide, wax, solid fatty acid, solid fatty alcohol, and opacifying resin.

58. A candle of claim 47 wherein the first melting point is between 90° F. and 200° F.

59. A candle of claim 47 wherein the second melting point is greater than the first melting point.

60. A candle of claim 47 wherein the second melting point is within about 30° F. of the first melting point.

61. A candle of claim 47 wherein at least one of the first phase and the second phase contains a decorative item.

62. A candle of claim 47 wherein the first and second phases have melting points such that the second phase can be brought into contact with molten first phase and the second phase will retain its shape.

63. A candle comprising a wick, a first phase and a second phase, wherein the first phase comprises a first gelled fuel, the first gelled fuel comprising a first gellant at a first concentration in a first solvent, the first phase having a first melting point; and the second phase comprises wax and has a second melting point, wherein a) the second melting point is greater than or about equal to the first melting point, and b) the second phase is adjacent to, and not encased by, the first phase.

64. A candle of claim 63 wherein the first solvent is selected from a group consisting of mineral oil, fatty acid ester, fatty acid glycol and fatty alcohol.

65. A candle of claim 63 wherein the first gelled fuel is substantially clear.

66. A candle of claim 63 positioned within a container.

67. A candle of claim 63 which is free-standing.

68. A candle of claim 63 having a coating that forms the exterior-most surface of the candle.

69. A candle of claim 63 wherein a coating comprising polyamide forms the exterior-most surface of the candle.

70. A candle of claim 63 comprising fragrance.

71. A candle of claim 63 comprising clarifying agent.

72. A candle of claim 63 comprising clarifying agent selected from $C_{10}$–$C_{22}$monocarboxylic acid or alkylene glycol.

73. A candle of claim 63 comprising an opacifying agent selected from the group consisting of paraffin, titanium dioxide, dye, zinc oxide, wax, solid fatty acid, solid fatty alcohol, and opacifying resin.

74. A candle of claim 63 wherein the first melting point is between 90° F. and 200° F.

75. A candle of claim 63 wherein the second melting point is greater than the first melting point.

76. A candle of claim 63 wherein the second melting point is within about 30° F. of the first melting point.

77. A candle of claim 63 wherein at least one of the first phase and the second phase contains a decorative item.

78. A candle of claim 63 wherein the first and second phases have melting points such that the second phase can be brought into contact with molten first phase and the second phase will retain its shape.

79. A process for preparing a candle, comprising combining a first phase, a second phase, and a wick, wherein the first phase comprises a first gelled fuel, the first gelled fuel comprising a first gellant at a first concentration in a first solvent, the first phase having a first melting point; and the second phase comprises wax and has a second melting point, wherein a) the second melting point is greater than or about equal to the first melting point, and b) the second phase is adjacent to, and not encased by, the first phase.

80. A process for preparing a candle, comprising combining a first phase, a second phase, and a wick, wherein the first phase comprises a first gelled fuel, the first gelled fuel comprising a first gellant at a first concentration in a first solvent, the first phase having a first melting point; and the second phase comprises wax and has a second melting point, wherein the second melting point is greater than or about equal to the first melting point.

81. A process for preparing a candle, comprising combining a first phase, a second phase, and a wick, wherein the first phase comprises a first gelled fuel, the first gelled fuel comprising a first gellant at a first concentration in a first solvent, the first phase having a first melting point; and the second phase comprises wax and has a second melting point, wherein the second phase is adjacent to, and not encased by, the first phase.

* * * * *